US012222175B2

(12) United States Patent
Dvorak

(10) Patent No.: US 12,222,175 B2
(45) Date of Patent: Feb. 11, 2025

(54) PNEUMATIC COUNTING APPARATUS FOR A WEAPON SIMULATOR

(71) Applicant: Vojtech Dvorak, Tulsa, OK (US)

(72) Inventor: Vojtech Dvorak, Tulsa, OK (US)

( * ) Notice: Subject to any disclaimer, the term of this patent is extended or adjusted under 35 U.S.C. 154(b) by 711 days.

(21) Appl. No.: 17/308,989

(22) Filed: May 5, 2021

(65) Prior Publication Data

US 2022/0074694 A1 Mar. 10, 2022

Related U.S. Application Data

(60) Provisional application No. 63/020,535, filed on May 5, 2020.

(51) Int. Cl.
*F41A 19/01* (2006.01)
*F41A 33/06* (2006.01)

(52) U.S. Cl.
CPC ..... *F41A 19/01* (2013.01); *F41A 33/06* (2013.01)

(58) Field of Classification Search
CPC ..... F41A 19/01; F41A 33/06; F41B 11/62
USPC ..... 42/1.02; 124/45
See application file for complete search history.

(56) References Cited

U.S. PATENT DOCUMENTS 2,605,756 A * 8/1952 Bertschinger ..... F41B 11/647 124/58
6,854,480 B2 2/2005 Wilson, Jr. et al.
7,140,387 B2 11/2006 Wilson, Jr. et al.
8,602,784 B2 * 12/2013 Dvorak ..... F41B 11/62 434/18
8,899,985 B2 12/2014 Walls
9,719,747 B2 8/2017 Tiberius et al.
10,209,025 B2 2/2019 Tiberius et al.
10,436,539 B2 10/2019 Tiberius et al.
10,436,540 B2 * 10/2019 Bascom ..... F41A 33/00
10,976,128 B2 * 4/2021 LaMons ..... F41A 99/00
2005/0074726 A1 * 4/2005 Metcalfe ..... F41B 11/724 434/18
2010/0319668 A1 * 12/2010 Maeda ..... F41B 11/62 124/73
2012/0129136 A1 * 5/2012 Dvorak ..... F41A 33/06 434/18

(Continued)

*Primary Examiner* — Bret Hayes
(74) *Attorney, Agent, or Firm* — Scott R. Zingerman; David G. Woodral; James F. Lea

(57) ABSTRACT

A pneumatic counting apparatus for a weapon simulator having a magazine including a compressed gas storage reservoir including a toothed element adapted for articulation within the magazine. The toothed element including a plurality of steps, a first face and a second face. A wheel actuator including a lever for engaging the steps of said toothed element so as to articulate the toothed element. The toothed element including a pneumatic passage there through. A pneumatic branch is in communication with the gas storage reservoir and terminating at a sealed passage adjacent the first face of the toothed element. A pneumatic bridge extends between a pressure chamber and a pneumatic gate positioned adjacent and in selective pneumatic communication with the pneumatic passage on the second face of the toothed element. The pneumatic passage is adapted for selective communication of compressed gas between the passage and the pneumatic gate. A slide catch lifter is in pneumatic communication with said pressure chamber.

18 Claims, 13 Drawing Sheets

(56) References Cited

U.S. PATENT DOCUMENTS

| | | | | |
|---|---|---|---|---|
| 2015/0226516 | A1* | 8/2015 | Dvorak | F41B 11/62<br>124/73 |
| 2018/0149443 | A1* | 5/2018 | Dottle | F41A 33/02 |
| 2018/0356175 | A1 | 12/2018 | LaMons et al. | |

* cited by examiner

PNEUMATIC COUNTING APPARATUS FOR A WEAPON SIMULATOR

CROSS REFERENCE TO RELATED APPLICATION

This application claims the benefit of U.S. Provisional Application No. 63/020,535 filed May 5, 2020, herein incorporated by reference in its entirety for all purposes.

FIELD OF THE INVENTION

This disclosure relates generally to converting an actual firearm to a firearm simulator and more particularly to systems for counting simulated rounds fired by a firearm simulator.

BACKGROUND OF THE INVENTION

Firearms have been converted into firearm simulators by replacement of parts of the firearm with simulator parts for simulated shooting such that the resultant firearm comprises a combination of actual firearm components and simulated firearm components. The simulated firearm components have included a simulated barrel unit and a simulated magazine unit. The prior simulated magazine units have included a compressed gas container or a connection to an external compressed gas source. The compressed gas is used to provide energy to operate the weapon simulator by actuating valve means in the simulated barrel unit. The compressed gas is conducted from the compressed gas container, or the external compressed gas source to the simulated barrel unit. When actuated, the valve means forces movement of a slide and compression of a recoil spring and subsequent venting. The resulting recoil simulates the feel of actual weapon firing. A laser beam pulse means is responsive to the simulated weapon firing whereby the laser beam pulse means emits a laser beam onto a target.

One problem with simulated weapons using actual weapon components is that the simulated weapon does not expend actual ammunition. In an actual weapon, such as a semi-automatic handgun for example, ammunition rounds are contained in a magazine, typically inserted in the grip of the weapon. When a round is fired, shot or discharged, the cartridge shell is expended and the next cartridge, or round, is cycled into the chamber of the weapon. This is repeated until the last round is expended and the gun/magazine is "empty". When this occurs, it is common for the weapon to include a mechanism which holds/latches the bolt open, thus indicating to the operator that the gun is empty and the magazine removed and reloaded or a different magazine inserted. A need, therefore, exists for a counting mechanism for a firearm simulator which counts the number of simulated ammunition rounds held by the actual weapon magazine and "fired" by the firearm simulator. A need further exists for an apparatus which holds back/open the bolt of the weapon to indicate to the operator that the magazine is "empty".

SUMMARY OF THE INVENTION

The present invention comprises a pneumatic counting apparatus for a weapon simulator having a compressed gas storage reservoir including a toothed element adapted for articulation within the magazine. As used herein, the term "toothed element" is a structure which is adapted for receiving indexing motion from an actuator which corresponds to a simulated shot discharged by a firearm simulator and articulates in a predetermined manner in order to count or correspond to a predetermined number of such simulated shots available for a simulated magazine. The apparatus of the present disclosure including the compressed gas storage reservoir may be contained within a simulated magazine which engages the firearm simulator in a manner similar to an actual firearm. A slide (pistol) or bolt (rifle) may provide cyclic motion upon firing of the simulated firearm in a manner similar to an actual firearm. The toothed element includes a plurality of steps, a first face and a second face. An actuator which may include a lever or a plurality of teeth, is adapted for engaging the steps of the toothed element so as to articulate the toothed element. The articulation of the toothed element may preferably be linear or it may be circular but may be in any other manner. The toothed element preferably includes a pneumatic gate or passage there through. A pneumatic branch is in communication with the gas storage reservoir and terminating, preferably at a sealed passage, adjacent the first face of the toothed element. A pneumatic bridge extends from and is in selective pneumatic communication with the pneumatic gate on the second face of the toothed element. A pneumatic passage may be adapted for selective communication of compressed gas between the pneumatic bridge and the pneumatic gate. The pneumatic bridge may vent compressed gas from the apparatus to the atmosphere to simulate that the simulated magazine is "empty". In this case, the volume of compressed gas (air) in the compressed gas storage reservoir may be calibrated to supply the sufficient amount of gas to cycle the weapon simulator to simulate a predetermined number of shots or rounds. In addition or alternatively, the pneumatic bridge may extend from the pneumatic gate on the second face of the toothed element to a pressure chamber. A lifter may be positioned (spring biased) in pneumatic communication with the pressure chamber so as to engage the weapon slide or bolt to indicate that the magazine is "empty".

The actuator preferably indexes up and down biased by a spring. When it indexes down, a lever on the actuator advances to the next step on the toothed element. When it indexes up (biased by the spring) it articulates/advances the toothed element another position. The advancement may be circular, linear (either up or down) or in any other known manner. When a predetermined number of "shots" are fired by the weapon simulator corresponding to the predetermined number of steps/teeth on the toothed element, the pneumatic gate aligns between the pneumatic branch and the pneumatic bridge thereby allowing air into the pneumatic bridge. Air then enters the pressure chamber below the slide catch lifter. Air overcomes the spring bias and the slide catch lifter extends from the magazine to engage the slide catch on the slide/bolt of the weapon simulator which, in turn, immobilizes the weapon slide/bolt.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

BRIEF DESCRIPTION OF THE DRAWINGS

FIG. 13 depicts the end cross-section view FIG. 8 where the pneumatic passage of the toothed element is aligned with the sealed passages to allow pneumatic communication there through.

DETAILED DESCRIPTION OF THE PREFERRED EMBODIMENTS

Figure 1:
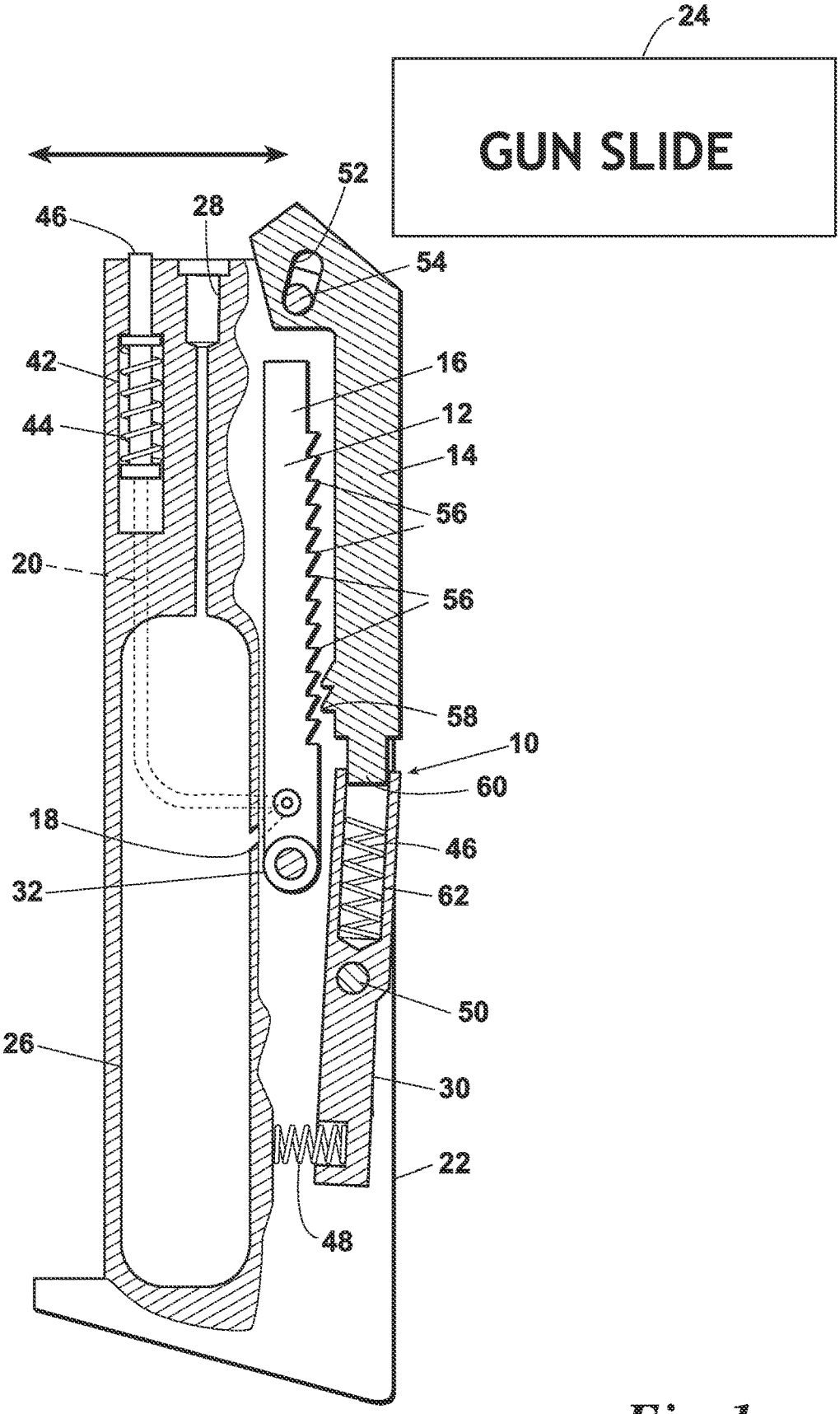
FIG. 1 depicts a cut-away side view of a first preferred embodiment of the pneumatic counting magazine of the present disclosure depicted with the slide retracted in the open position where the slide does not contact the actuator.

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

With reference to FIGS. 1-4, a first preferred embodiment of the pneumatic counting apparatus for a weapon simulator 10 of the present disclosure shall first be described. Apparatus 10 includes, generally, a toothed element 12 having a pneumatic gate 16 therethrough, actuator 14, a pneumatic branch 18, and a pneumatic bridge 20. The apparatus 10 of the present disclosure includes a compressed gas storage reservoir 26 which may be contained within a simulated magazine 22. Simulated magazine 22 engages the firearm simulator in a manner similar to an actual firearm.

Figure 4A:
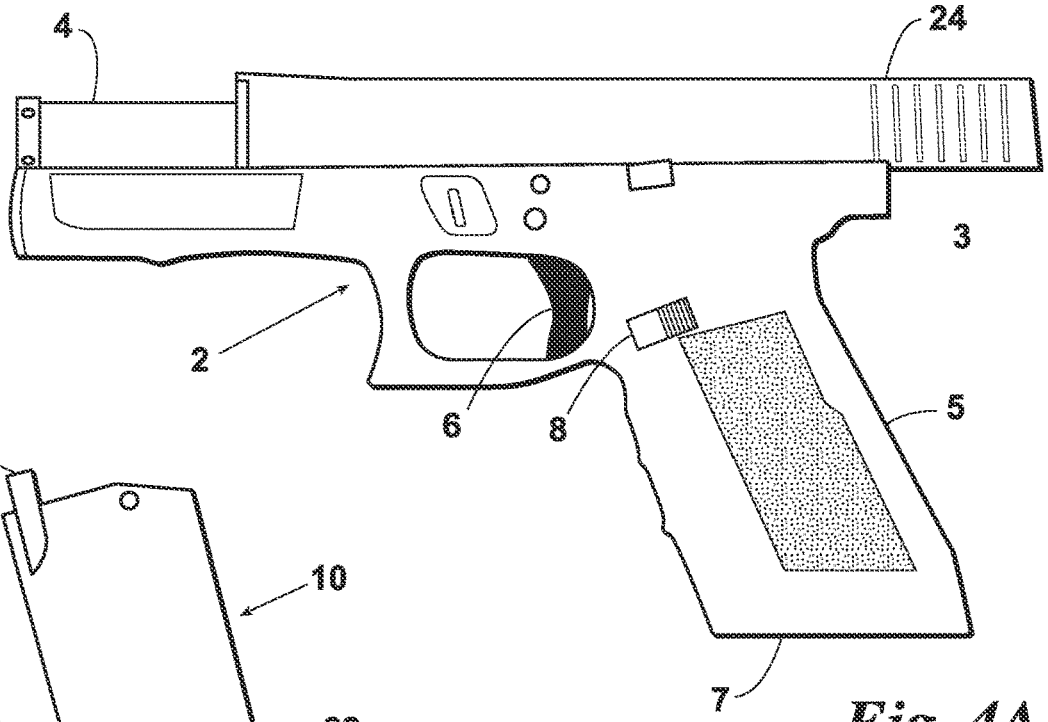
FIG. 4A depicts the counting magazine an exemplary simulated firearm apparatus of the present disclosure configured with a simulated magazine barrel from a side view adjacent a firearm simulator.
Figure 4B:
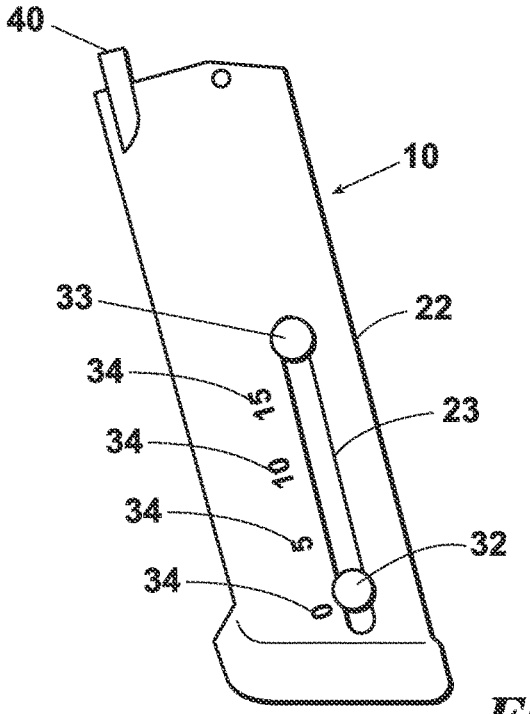
FIG. 4B depicts the counting magazine of the present disclosure from a side view adapted for the simulated firearm apparatus of FIG. 4A.

With specific reference to FIG. 4, apparatus 10 of the present disclosure may be embodied in simulated magazine 22 for use with a simulated firearm 2. Simulated firearm 2 may include a combination of actual firearm components and simulated firearm components. Such simulated firearms are known in the art, such as described in U.S. Pat. No. 8,602,784, incorporated fully herein by reference. For example, simulated firearm 2 may include the frame 3, trigger and mechanism 6, slide mechanism 24 of an actual firearm which may be modified with a simulated barrel 4. Simulated magazine 22 may be configured so as to be received in a cavity 7 formed in grip 5 of the actual firearm in the same manner as in an actual firearm. A magazine release 8 releases simulated magazine 22 from cavity 7 in the same manner as an actual firearm. Slide 24 may provide cyclic motion upon firing of simulated firearm 2 in a manner similar to an actual firearm. In a rifle example, a bolt, such as bolt 1424 of FIG. 14, would provide the cyclic motion upon firing of the simulated firearm. Magazine 22 may include an outlet 28 in gas flow communication with compressed gas reservoir 26 to allow compressed gas in gas reservoir 26 to power the simulator and create the firearm simulator cycling motion.

Figure 9:
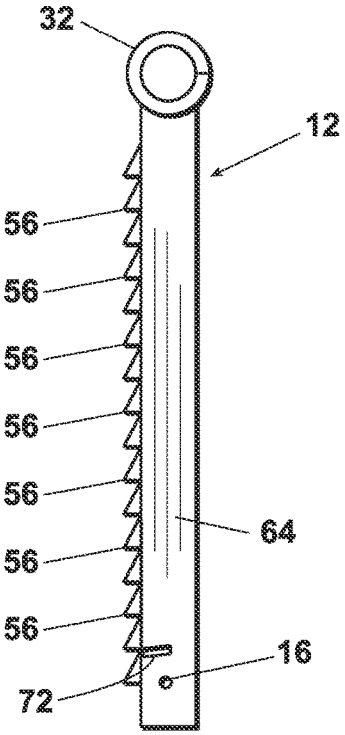
FIG. 9 depicts a second face of the second preferred embodiment linear slider including a pneumatic passage and a vent notch.

Referring again to FIGS. 1-4, toothed element 12 is adapted for articulation within magazine 22. Toothed element 12 includes a plurality of steps, collectively 56, a first face 64 (FIG. 11) and a second face 66 (FIG. 9). Actuator 14 (including a plurality of teeth, collectively 58 and described further below) is adapted for engaging the steps 56 of toothed element 12 so as to articulate toothed element 12. The articulation of toothed element 12 of the preferred embodiments is linear. Toothed element 12 includes a pneumatic gate or passage 16 there through. Pneumatic branch 18 is in communication for the flow of gas (air) from gas storage reservoir 26 and terminating, preferably at a sealed bearing 68, adjacent first face 64 of toothed element 12. Bearing 68 seals against first face 64 so as to prevent the escape of compressed gas. Pneumatic branch 18 leading from compressed gas storage reservoir 26 to pneumatic gage 16 may include a pressure regulator or pressure reducer 36. Pressure reducer 36 may include a spring biased ball valve wherein ball 37 is biased by spring 38 inside and against pneumatic branch 18. Spring 38 may be selected such that a predetermined pressure could unseat ball 37, thereby reducing the amount of pressure upon toothed element 12 sealed against bearing 68.

Figure 12:
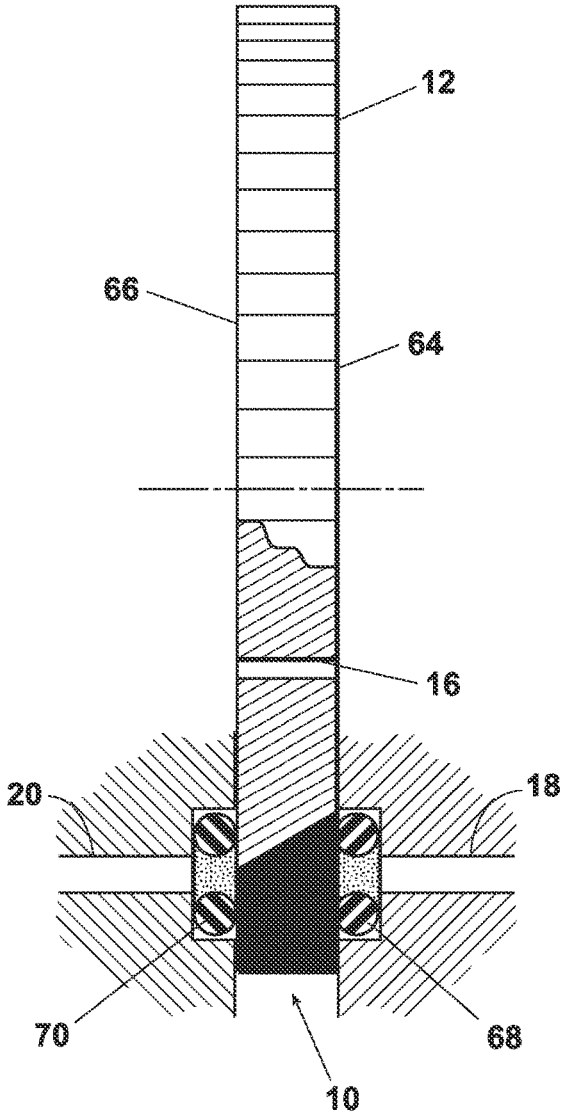
FIG. 12 depicts an end cross-section view of the toothed element and the sealed passages against the toothed element in a closed position.
Figure 13:
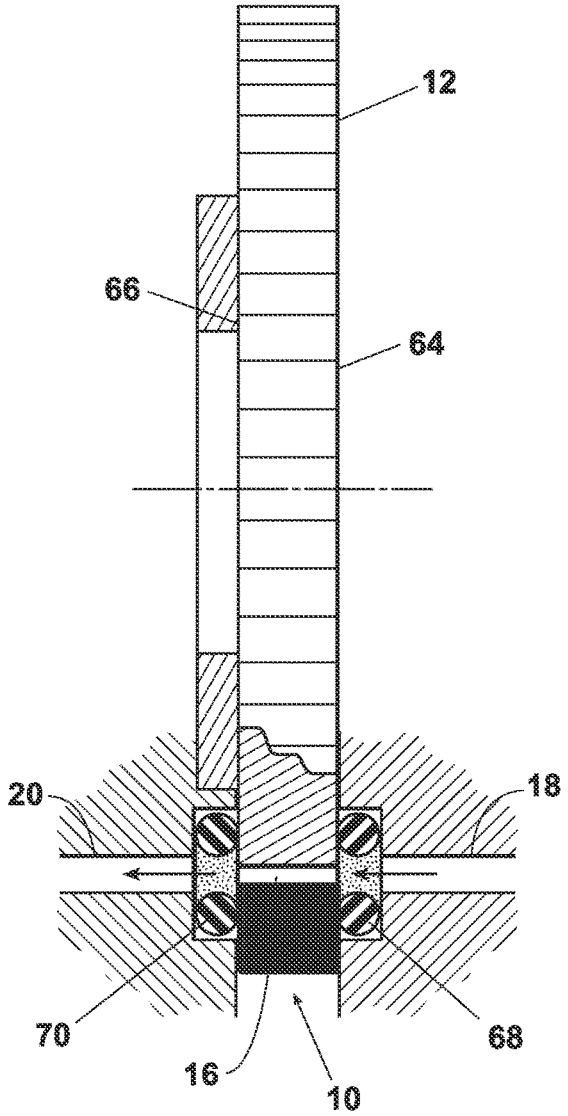

With particular reference to FIGS. 12 and 13, pneumatic bridge 20 extends from second face 66 of toothed element 12. Pneumatic gate 16 is adapted for selective communication (flow or passage) of compressed gas between pneumatic branch 18 and pneumatic bridge 20. Pneumatic bridge 20 may vent compressed gas from apparatus 10 to the atmosphere to simulate that the simulated magazine is "empty". In this basic embodiment, the volume of compressed gas (air) in the compressed gas storage reservoir 26 may be calibrated to supply only an amount of gas sufficient to cycle the weapon simulator to simulate a predetermined number of times simulating shots or rounds discharged from simulated weapon 2. In addition or alternatively, pneumatic bridge 20 may extend from pneumatic gate 16 on the second face 66 of toothed element 14 to a pressure chamber 42. A lifter 40 may be positioned (spring biased) in pneumatic communication within pressure chamber 42 so as to engage the (gun) slide 24 (or bolt in a rifle embodiment) to indicate that the magazine 22 is "empty." The apparatus of the present disclosure may include means for stopping the firing cycle of the weapon simulator when toothed element 12 is advanced so as to line up pneumatic gate 16 with pneumatic branch 18 and pneumatic bridge 20 to allow compressed air from reservoir 26 to activate lifter 40 which extends a catch on the weapon's slide 24 to interrupt the simulated weapon cycling motion. Toothed element 12 preferably includes a vent notch 72 (FIG. 9) on second face 66 adapted to relieve pressure from under lifter 40 to allow it to retract within pressure chamber 42 to allow slide 24 to retract (close).

Figure 11:
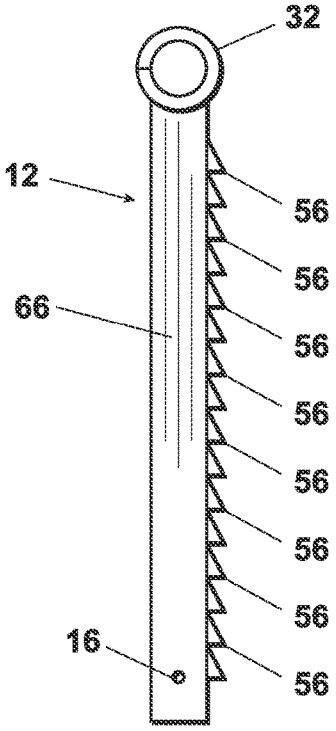
FIG. 11 depicts a first face of the second preferred embodiment linear slider including a pneumatic passage.

As depicted in FIGS. 9 and 11, tooth element 12 is a bar including a plurality of steps 56 along its length such that at least one tooth 58, and preferably a plurality of teeth 58 on actuator 14 engage steps 56. Actuator 14 preferably indexes up and down biased by a spring 46. When actuator 14 indexes down, teeth 58 on actuator 14 advances to the next step on the toothed element 12. When actuator 14 indexes up (biased by spring 46) it articulates/advances toothed element 12 another position.

Toothed element 12 in this embodiment is a linear bar which includes a longitudinal axis and is adapted for articulation along its linear axis. Actuator 14 also includes a longitudinal axis such that actuator 14 is adapted for movement along its longitudinal axis in association with contact with slide 24 or other reciprocating part of simulated weapon 2 producing the cyclic motion. Rocker 30 is secured by pin 50 within magazine 22 such that rocker 30 is adapted for pivotal (rocking) motion with magazine 22. A rocker 30 is adapted to disengage actuator 14 from toothed element 12 to allow for manually sliding a counter on thumb slide 32 to return it to full count (aligned with indicia 34) or to any desired round count. Rocker 30 is also adapted for engaging actuator 14. Actuator 14 includes a shoulder 60 and rocker 30 includes a cavity 62 adapted for receiving shoulder 60 such that shoulder 60 is adapted for movement within cavity 62. In this preferred embodiment, shoulder 60 is adapted for partial movement into and out of cavity 62. A spring is positioned in cavity 62 beneath shoulder 60 for biasing actuator 14 along its longitudinal axis.

Figure 2:
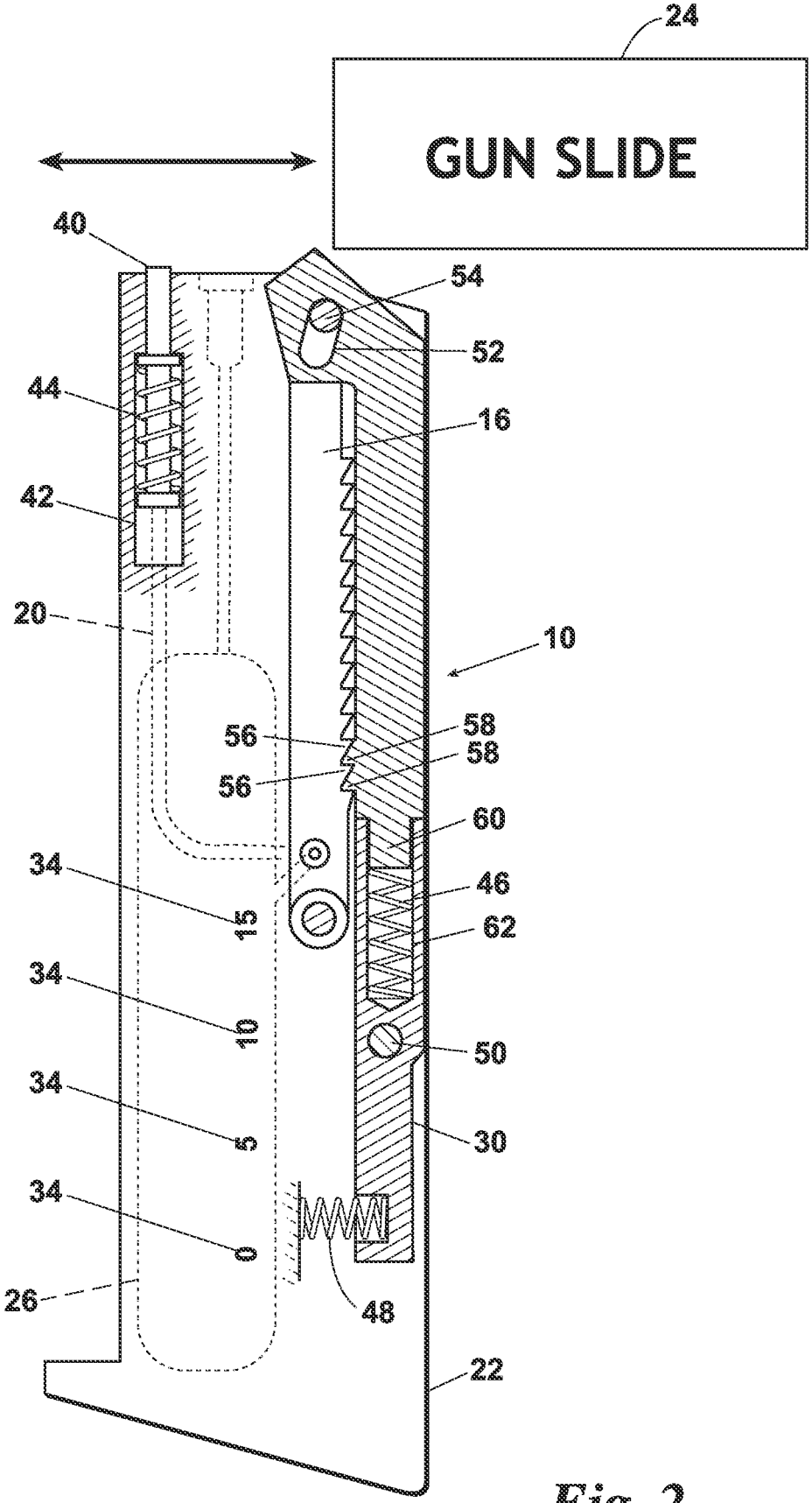
FIG. 2 depicts the cut-away side view of the first preferred embodiment of the pneumatic counting magazine of FIG. 1 depicted with the slide closing where the slide contacts (or indexes) the actuator.
Figure 3:
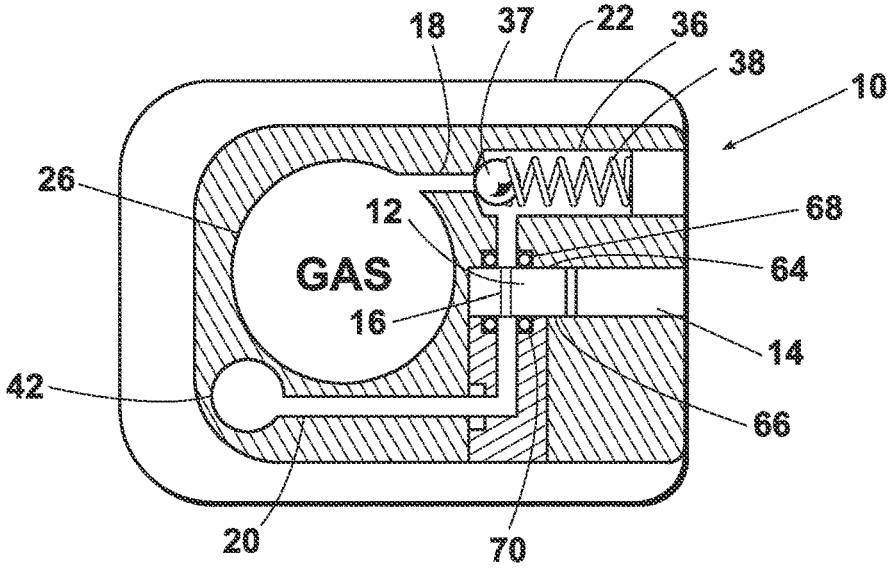
FIG. 3 depicts a lateral cut-away longitudinal view of the first preferred embodiment pneumatic counting magazine of the present disclosure.

Actuator 14 is secured in magazine 22 by a pin 54 which extends through a slot 52. Slot 52 allows actuator 14 to pivot within magazine 22. At least one tooth 58 of actuator 14 engages one of steps 56 on linear bar toothed element 12 such that movement of actuator 14 along its longitudinal axis in a first direction to a first position (as depicted in FIG. 2) against spring 46 in association with contact with slide 24 causes linear bar toothed element 12 to move along as longitudinal axis.

Once slide 24 is racked backward in response to the recoil of a simulated shot fired by simulated firearm 2, spring 46 biases shoulder 60 of actuator 14 in a second direction to a second position in cavity 62 away from rocker 30 enabling rocker 30 to pivot about pivot pin 50 and actuator 14 to pivot about mounting pin 54. In this second position, both rocker 30 and actuator 14 are out of alignment with the longitudinal axis of actuator 14. Shoulder 60 is biased out of cavity 62 by spring 46 such that shoulder is canted with respect to cavity 62. Teeth 58 are disengaged from steps 56 in linear bar toothed element 12. Spring 48 biases actuator 14 to this second position as is depicted in FIG. 1.

Upon initiation, slide 24 of simulated firearm 2 may be actuated, or "racked" in a manner consistent with an actual firearm. When a predetermined number of "shots" are fired by the weapon simulator corresponding to the predetermined number of steps/teeth on the toothed element 12, pneumatic gate 14 aligns between pneumatic branch 18 and pneumatic bridge 20 thereby allowing air to pass from pneumatic branch 18 through pneumatic gate 16 into pneumatic bridge 20. Such air then enters pressure chamber 42 below lifter 44. That air overcomes the bias from spring 44 and lifter 40 extends from magazine 22 to engage the slide catch on the slide/bolt 24 of the weapon simulator which, in turn, immobilizes the weapon slide/bolt.

Toothed element 12 has a thumb knob 32 for manually sliding bar element 12 into a desired position corresponding with a round count. Indicia, collectively 34, on magazine 22 may correspond to the number of simulated rounds in magazine 22. Thumb knob 32 may be manually manipulated to coincide with a predetermined desired number of rounds (which may coincide with the volume of compressed gas in compressed gas reservoir 26 as described above).

Figure 5:
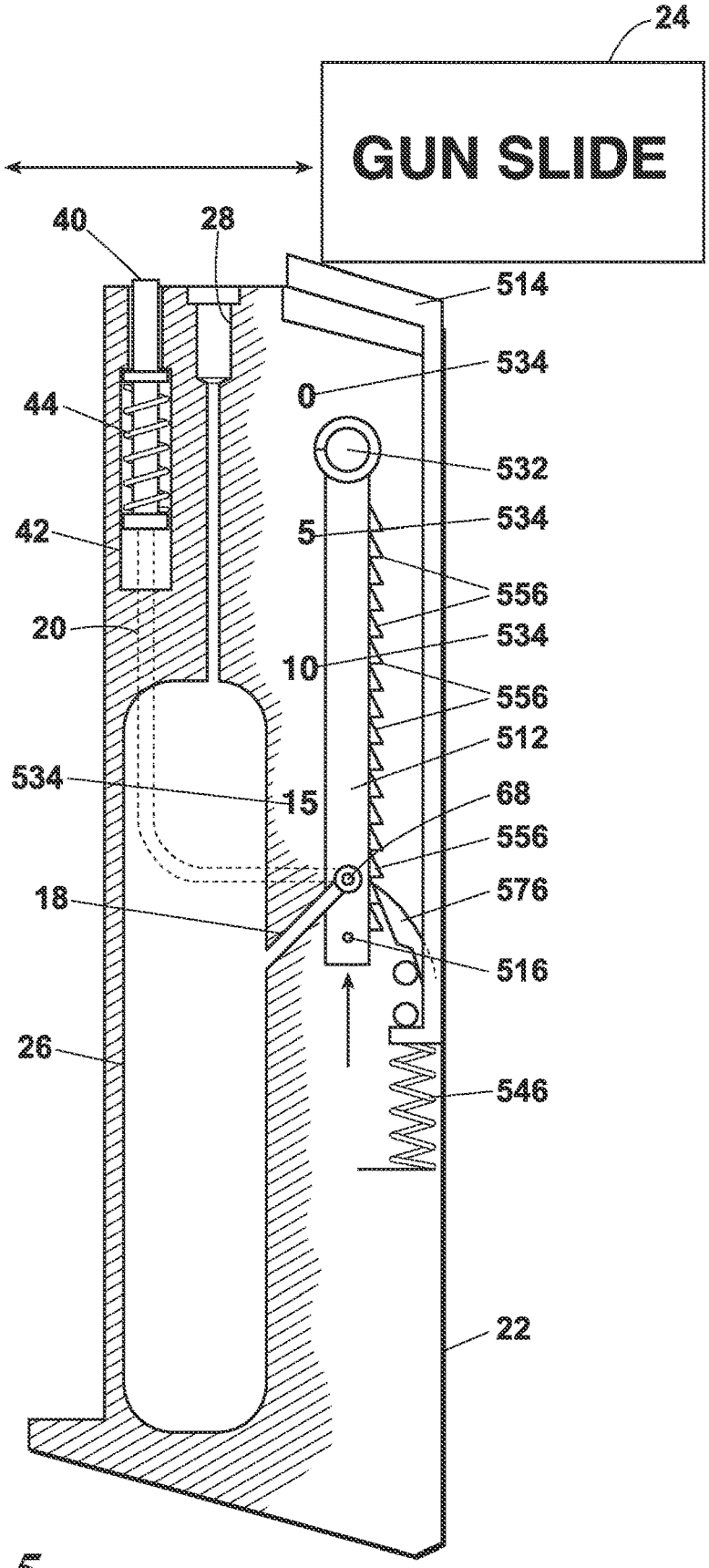
FIG. 5 depicts a side cut-away view of a second preferred embodiment pneumatic counting magazine of the present disclosure without a pressure reducer.

Next with reference to FIG. 5, a second preferred embodiment shall be described. The second preferred embodiment of FIG. 5 is substantially the same as the first preferred embodiment as described above with the exception of the toothed element and the actuator. Where parts are the same, the same part numbers are applied.

In this second preferred embodiment, actuator 514 includes a lever 576 adapted for engaging steps, collectively 556 of toothed element 512 such that indexing of actuator 514 causes lever 576 to engage a tooth 556 of toothed element 512 causing it to advance or articulate. Toothed element 512 is positioned upside down from the orientation of the embodiment of FIGS. 1-4, as a result, the indicia on simulated magazine 22 is oriented in the opposite direction of FIGS. 1-4.

Actuator 514 preferably indexes up and down biased by spring 546. When it indexes down, lever 576 on actuator 514 advances to the next step on toothed element 512. When it indexes up (biased by spring 546) it articulates/advances toothed element 512 another position. When a predetermined number of "shots" are fired by weapon simulator 2 corresponding to the predetermined number of steps 556 on toothed element 512, the pneumatic gate 516 aligns between pneumatic branch 18 and pneumatic bridge 20 thereby allowing air through pneumatic gate 516 and into pneumatic bridge 20. Air then enters pressure chamber 42 below lifter 40 as described above. Air overcomes the bias from spring 44 and lifter 40 extends from magazine 22 to engage the slide catch on the slide 24 of weapon simulator 2 which, in turn, immobilizes the weapon slide 24.

Figure 6:
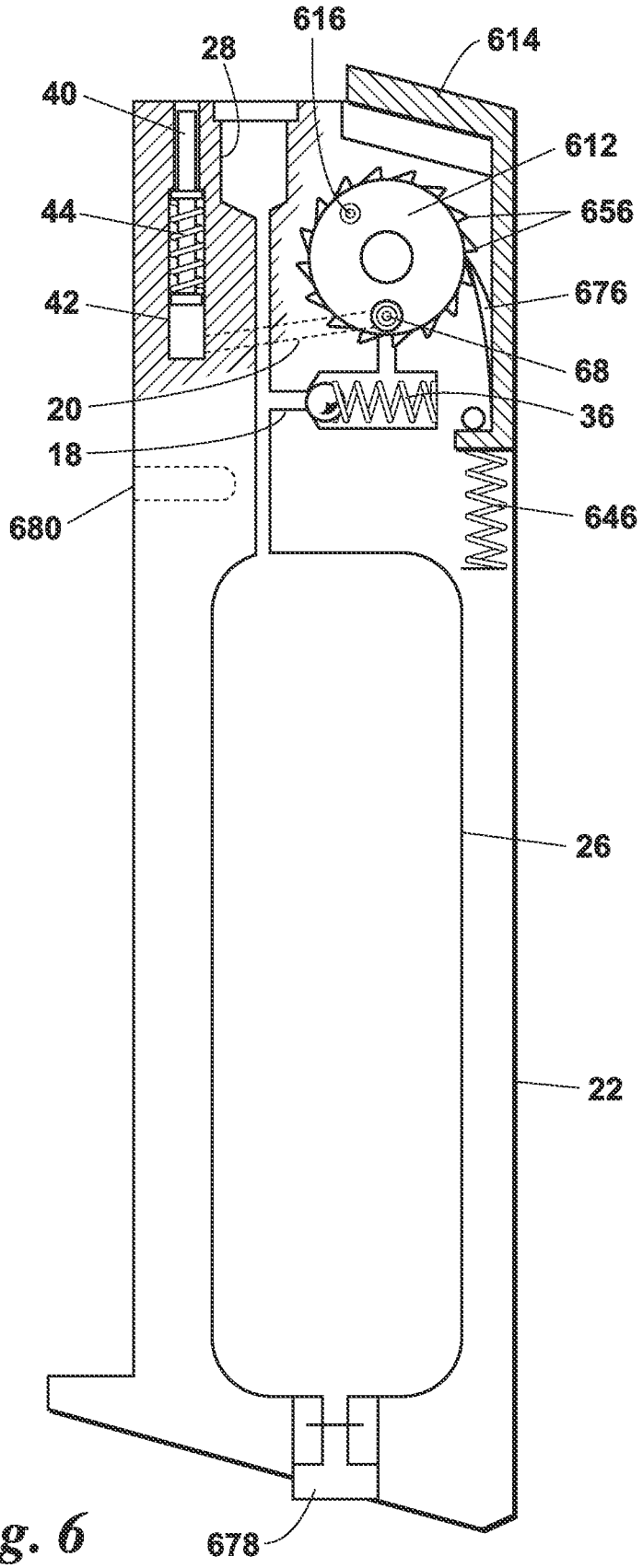
FIG. 6 depicts the cut-away side view of the embodiment of FIG. 7 depicted with a pressure reducer.
Figure 7:
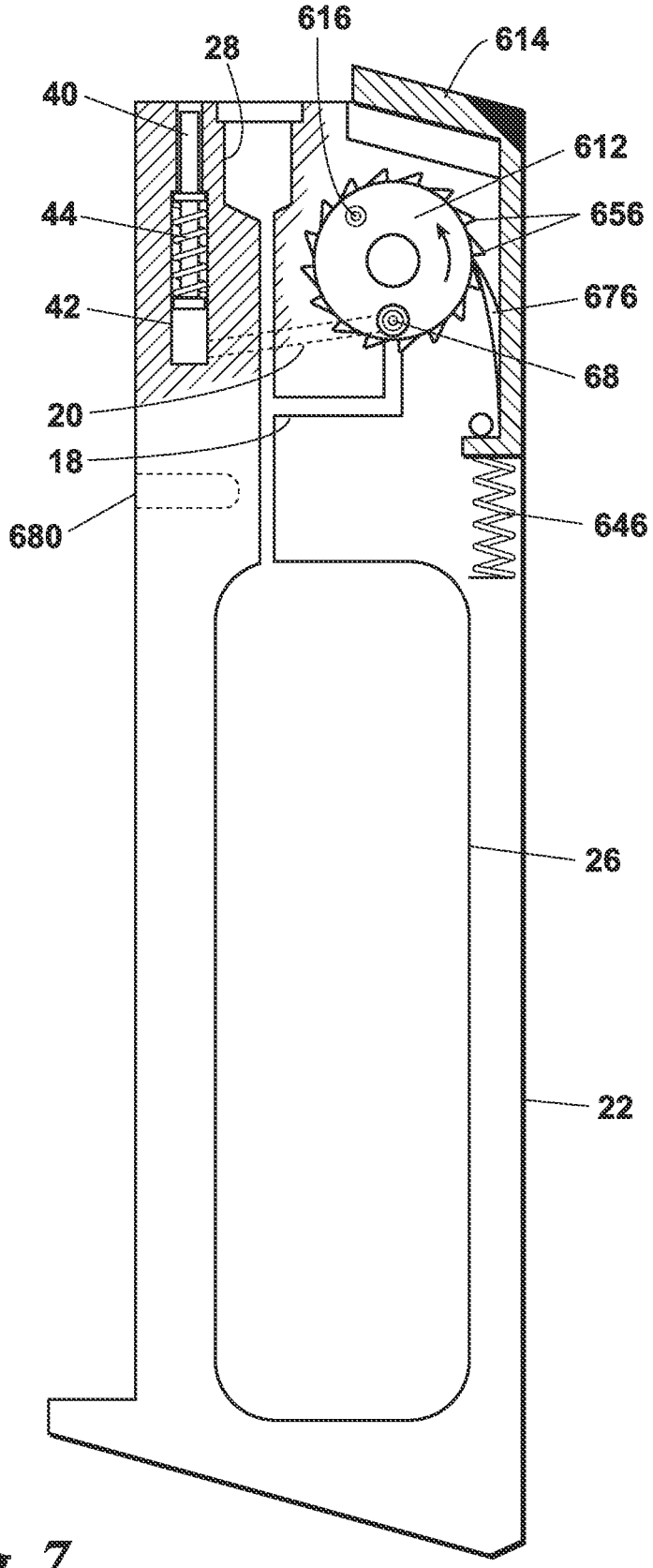
FIG. 7 depicts a side cut-away view of an alternative embodiment of the pneumatic counting magazine of the present invention wherein the toothed element is configured as a toothed wheel.

With reference to FIGS. 6-7, an alternate embodiment shall be described. The alternate embodiment of FIGS. 6-7 is substantially the same as the first preferred embodiment as described above with the exception of the toothed element and the actuator. Where parts are the same, the same part numbers are applied.

In alternate embodiment, actuator 614 includes a lever 576 adapted for engaging steps, collectively 556 of toothed element 612 such that indexing of actuator 514 causes lever 576 to engage a tooth 556 of toothed element 612 causing it to advance or articulate. Toothed element 612 is a wheel having a circumference and the circumference including a plurality of steps, collectively 656, thereon. Actuator 614 is adapted for engaging steps 656. Toothed element 612 includes two gates 616.

Figure 8:
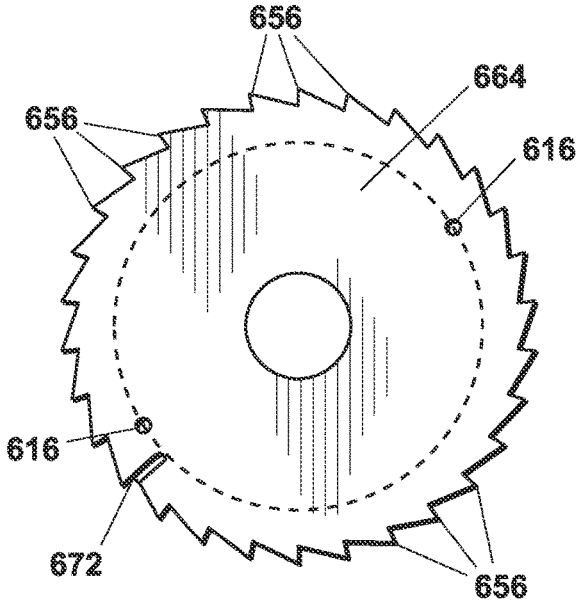
FIG. 8 depicts a second face of a toothed wheel of the present disclosure and depicting two pneumatic passages and a vent notch to release the pressure in the pressure chamber.
Figure 10:
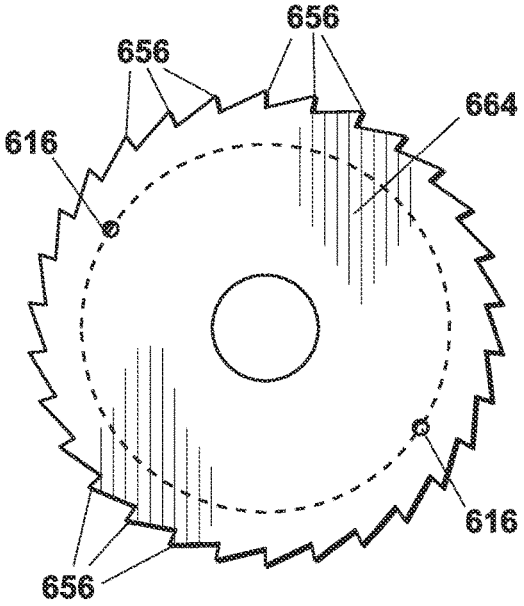
FIG. 10 depicts a first face of a toothed wheel of the present disclosure and depicting two pneumatic passages.

As depicted in FIGS. 8 and 10, tooth element 612 is a wheel including a plurality of steps 656 along its circumference such that at least one tooth (not shown but akin to 58, e.g. FIG. 1), and preferably a plurality of teeth on actuator 614 engage steps 656. Toothed element 612 preferably includes a vent notch 672 (FIG. 8) on face 664 adapted to relieve pressure from under lifter 40 to allow it to retract within pressure chamber 42 to allow slide 24 to retract (close).

Actuator 614 indexes up and down biased by spring 646. When it indexes down, lever 676 on actuator 614 advances to the next step on toothed wheel element 612. When it indexes up (biased by spring 646) it articulates/advances toothed element 612 another rotational position. When a predetermined number of "shots" are fired by weapon simulator 2 corresponding to the predetermined number of steps 656 on toothed element 612, the pneumatic gate 616 aligns between pneumatic branch 18 and pneumatic bridge 20 thereby allowing air through pneumatic gate 616 and into pneumatic bridge 20. Air then enters pressure chamber 42 below lifter 40 as described above. Air overcomes the bias from spring 44 and lifter 40 extends from magazine 22 to engage the slide catch on the slide 24 of weapon simulator 2 which, in turn, immobilizes the weapon slide 24.

Magazine 22 of FIG. 6 includes a pressure relief valve 678 to allow compressed gas with reservoir 26 to escape. In addition, magazine 22 includes a magazine catch 680 which operates in conjunction with magazine release 8 of FIG. 4 in a known manner.

FIGS. 14-17 depict the pneumatic counting apparatus of the present disclosure embodied in a magazine for use with a bolt action group of a rifle. Toothed element 1412 is adapted for articulation within magazine 1422. Toothed element 1412 includes a plurality of steps, collectively 1456, positioned around its circumference. Actuator 1414 includes a rocker 1430 adapted for engaging steps 1456 of toothed element 1412 so as to articulate toothed element 1412. The articulation of toothed element 1412 is linear. Toothed element 1412 includes a pneumatic gate or passage 16 there through. Pneumatic branch 1418 is in communication for the flow of gas (air) from gas storage reservoir 1426A-C and terminating, preferably at a sealed bearing 1468, at toothed element 1412. Bearing 1468 seals against toothed element 1412 so as to prevent the escape of compressed gas. Pneumatic branch 1418 leading from compressed gas storage reservoir 1426A to pneumatic gate 1416 may include a pressure regulator 1435 or pressure reducer.

Pneumatic bridge 1420 extends from second face 1466 of toothed element 1412. Pneumatic gate 1416 is adapted for selective communication (flow or passage) of compressed gas between pneumatic branch 1418 and pneumatic bridge 1420. Pneumatic bridge 1420 may vent compressed gas from apparatus 1410 to the atmosphere to simulate that the simulated magazine is "empty". In this basic embodiment, the volume of compressed gas (air) in the compressed gas storage reservoir 1426 may be calibrated to supply only an amount of gas sufficient to cycle the weapon simulator to simulate a predetermined number of times simulating shots or rounds discharged from simulated weapon 2. In addition or alternatively, pneumatic bridge 1420 may extend from pneumatic gate 1416 to a pressure chamber 1442. A lifter 1440 may be positioned in pneumatic communication within pressure chamber 1442 so as to engage the (gun) bolt 1424 to indicate that the simulated magazine 1422 is "empty." The apparatus of the present disclosure may include means for stopping the firing cycle of the weapon simulator when toothed element 1412 is advanced so as to line up pneumatic gate 1416 with pneumatic branch 1418 and pneumatic bridge 1420 to allow compressed air from reservoir 1426A-C to activate lifter 1440 which interrupts the weapon's cycling motion. Toothed element 1412 preferably includes a vent 1472 to relieve pressure from under lifter 1440 to allow it to retract within pressure chamber 1442 to allow bolt 1424 to retract (close).

Tooth element 1412 is a wheel including a plurality of steps 1456 along its circumference such that rocker 1430 on actuator 1414 engage steps 1456. Actuator 1414 indexes up and down biased by spring 1446. When it indexes down, rocker 1430 on actuator 1414 advances to the next step on toothed wheel element 1412. When it indexes up (biased by spring 1446) it articulates/advances toothed element 1412 another rotational position. When a predetermined number of "shots" are fired by the weapon simulator corresponding to the predetermined number of steps 1456 on toothed element 1412, the pneumatic gate 1416 aligns between pneumatic branch 1418 and pneumatic bridge 1420 thereby allowing air through pneumatic gate 1416 and into pneumatic bridge 1420. Air then enters pressure chamber 1442 below lifter 1440 as described above. Lifter 1440 extends from magazine 1422 to engage the bolt 1424 of the weapon simulator which, in turn, immobilizes the weapon bolt 1424.

Figure 14:
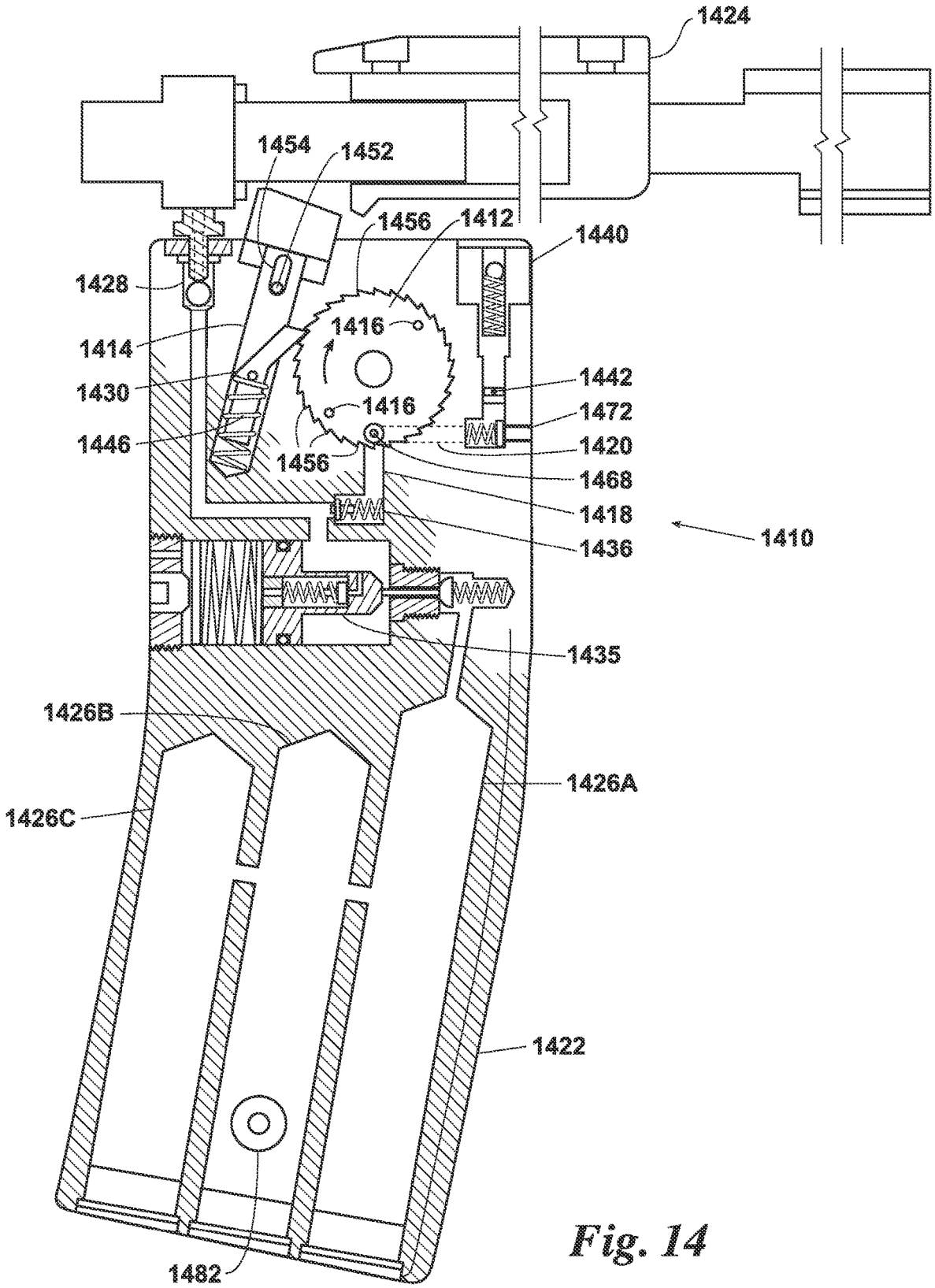
FIG. 14 depicts an alternate embodiment pneumatic counting magazine of the present disclosure configured for use with a rifle and depicts engagement with a simulated bolt carrier.
Figure 15:
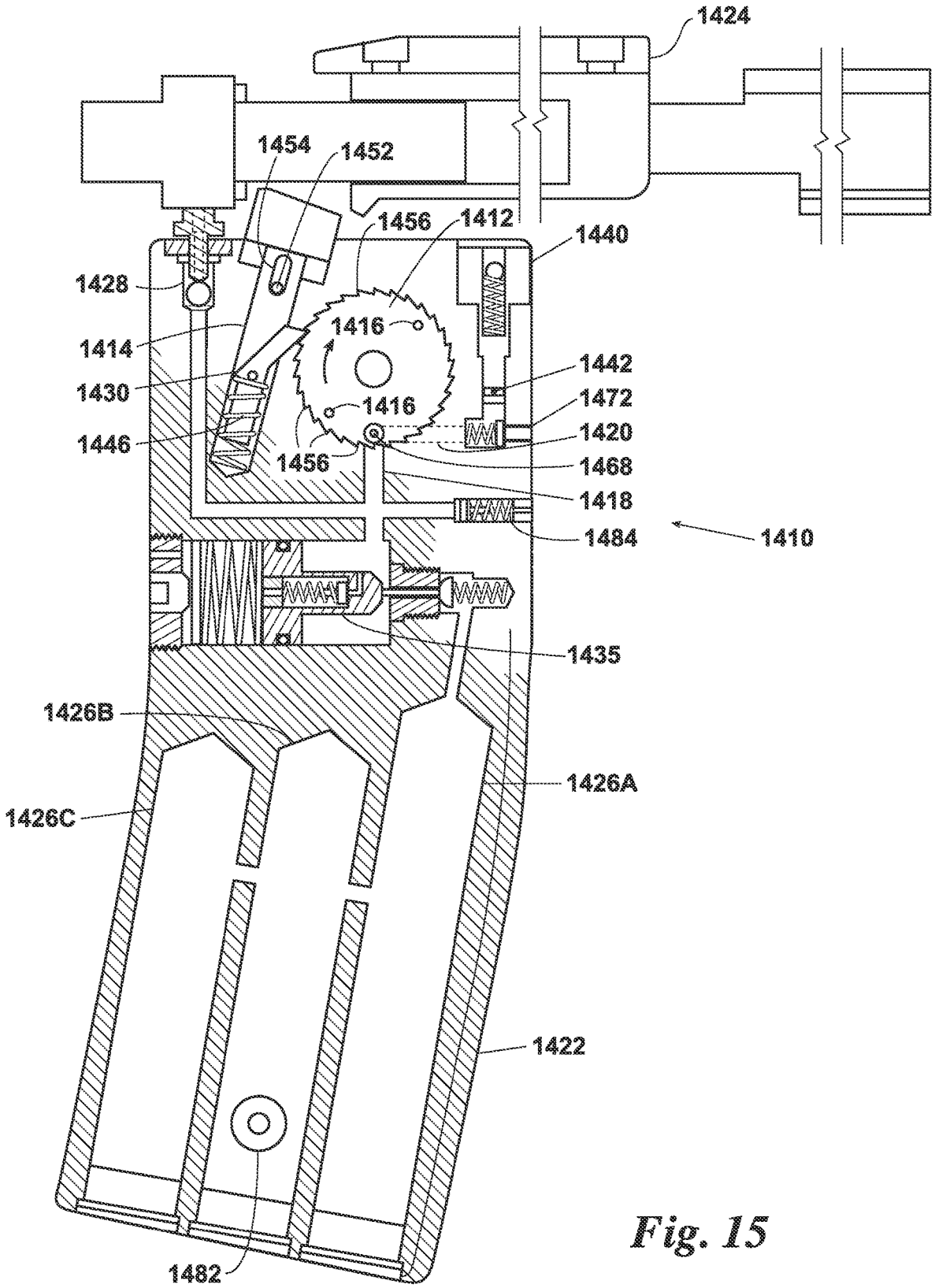
FIG. 15 depicts the embodiment of FIG. 14 further including a pressure reducing apparatus.

FIG. 15 depicts the apparatus 1410 of FIG. 14 but further including a pressure relief valve 1484.

Figure 17:
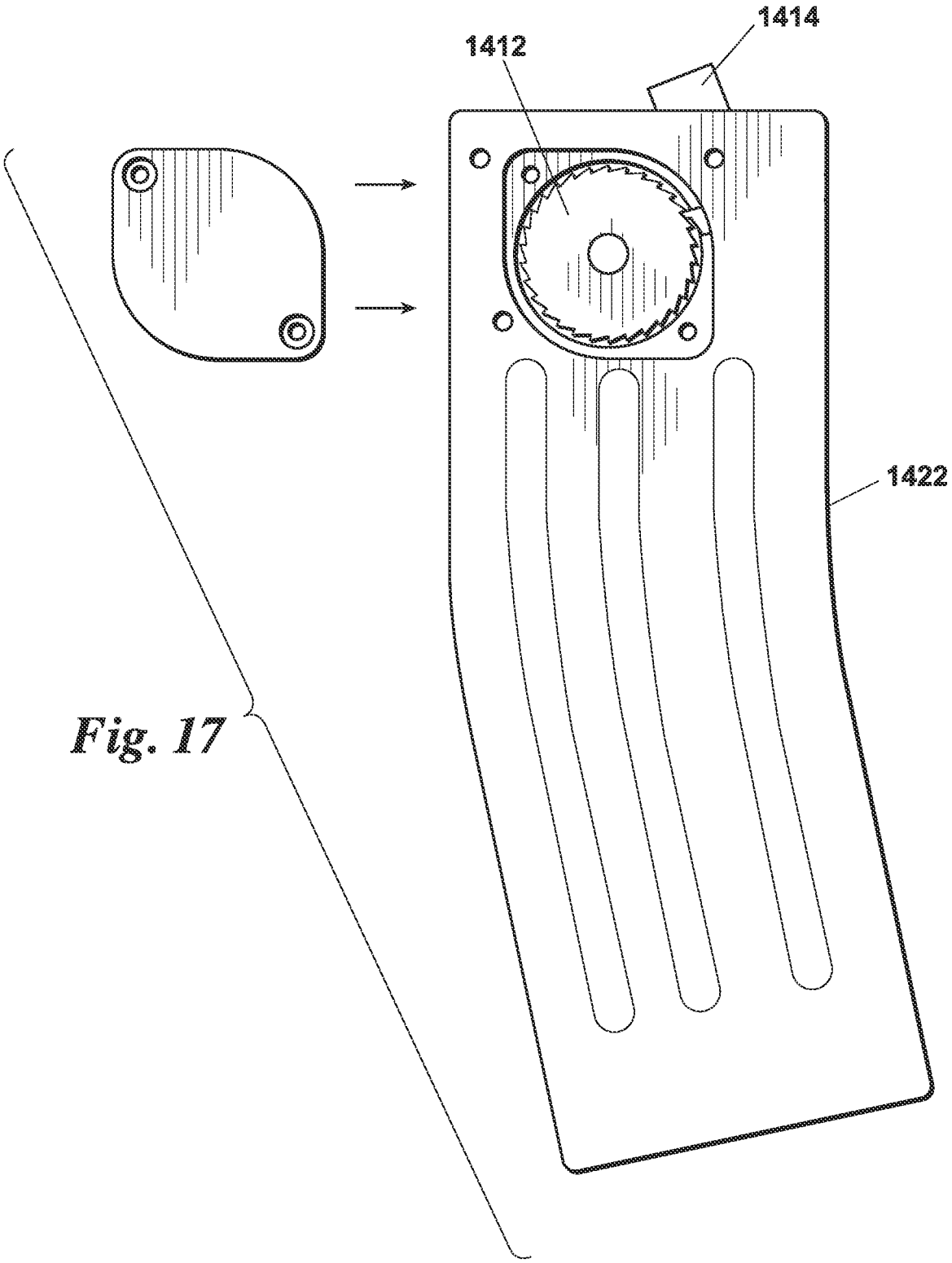
FIG. 17 depicts the alternate embodiment of FIG. 14 with a portion of the magazine housing removed to reveal the toothed element.

FIG. 17 depicts the embodiment of FIG. 14 with a portion of the magazine housing removed to reveal the toothed element 1412.

Figure 16A:
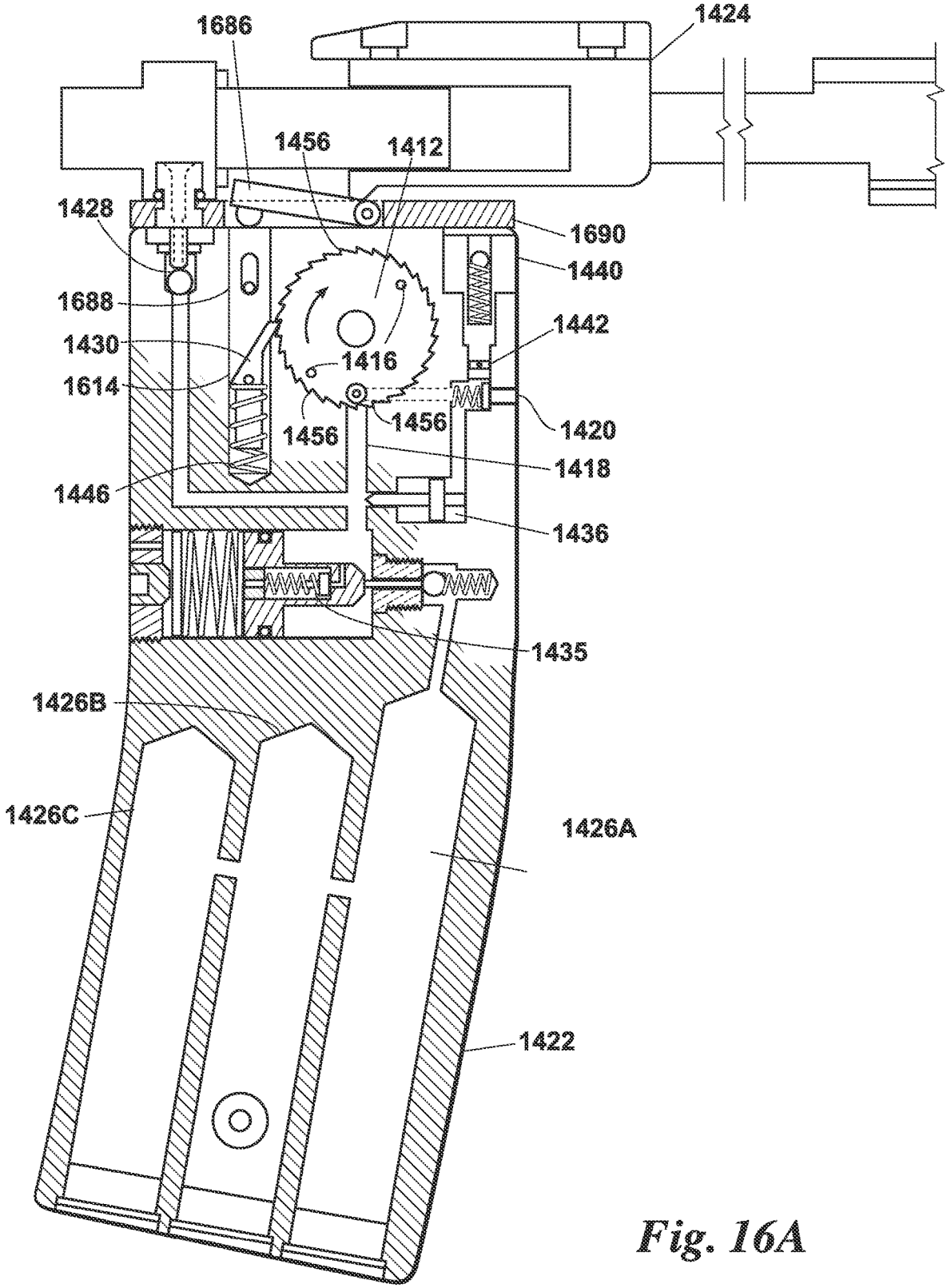
FIG. 16A depicts a second alternate embodiment pneumatic counting magazine of the present disclosure configured for use with a rifle and depicting the weapon bolt in a closed position.
Figure 16B:
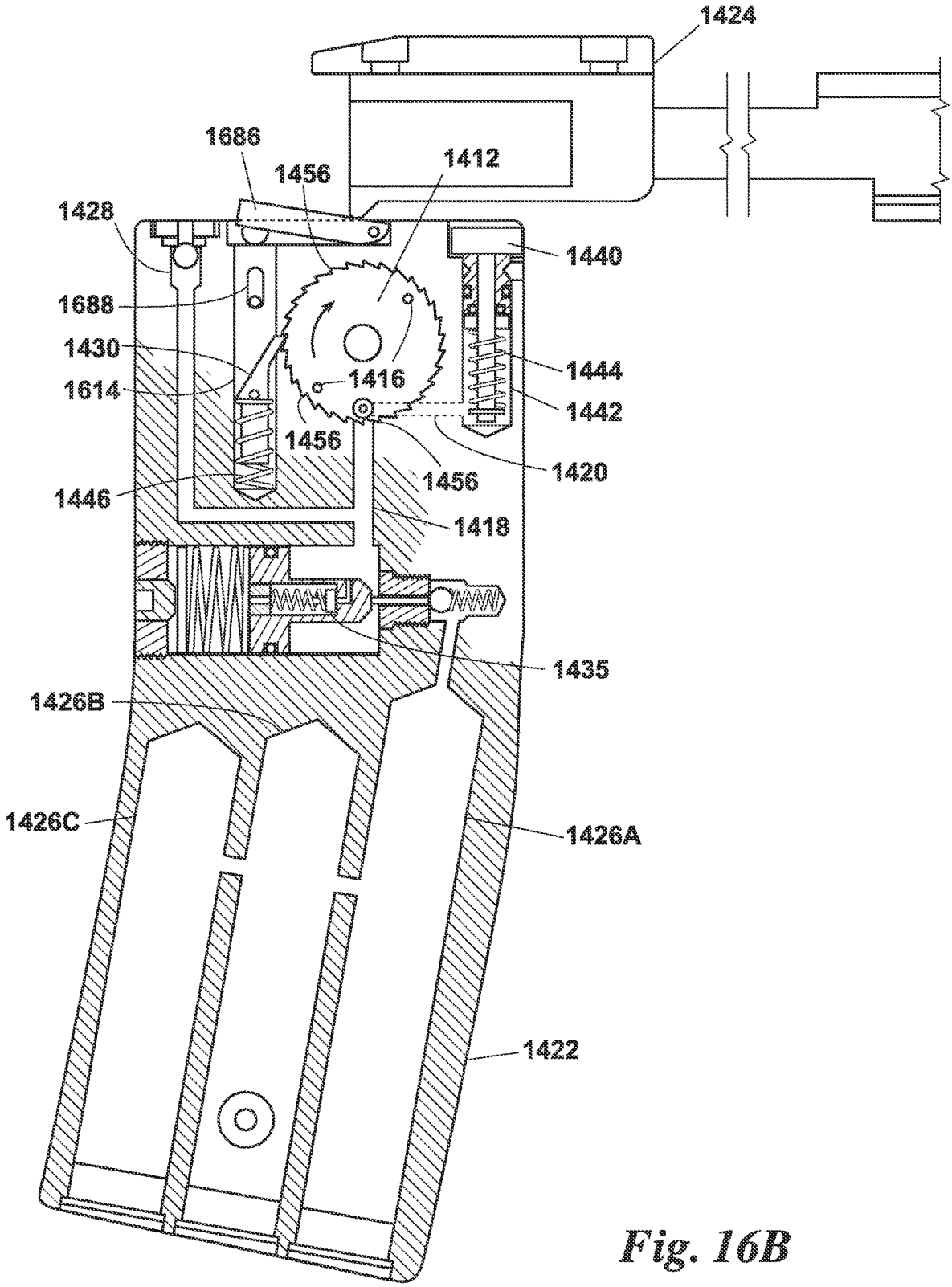
FIG. 16B depicts the embodiment of FIG. 16A with the weapon bolt in an open position.

FIGS. 16A and 16B depict an alternate embodiment which shall next be described. The alternate embodiment of FIGS. 16A and 16B is substantially the same as the embodiment of FIGS. 14 and 15 with the exception of the toothed element and the actuator. Where parts are the same, the same part numbers are applied. FIG. 16A depicts bolt 1424 in a closed position while FIG. 16B depicts bolt 1424 in an open position.

In this embodiment, actuator 1614 includes a flapper 1686 adapted for indexing a body 1614 such that indexing of actuator 1614 causes rocker 1430 to engage a tooth 1456 of toothed element 1412 causing it to advance or articulate. Toothed element 1412 is a wheel having a circumference and the circumference including a plurality of steps, collectively 1456, thereon. Rocker 1430 is adapted for engaging steps 1456. Toothed element 1412 includes two gates 1416.

Toothed element 1412 preferably includes a vent 1420 adapted to relieve pressure from under lifter 1440 to allow it to retract within pressure chamber 1442 to allow bolt 1424 to retract (close).

Actuator 1614 indexes up and down biased by spring 1446. When it indexes down, rocker 1430 on actuator 1614 advances to the next step on toothed wheel element 1412. When it indexes up (biased by spring 1446) it articulates/advances toothed element 1412 another rotational position. When a predetermined number of "shots" are fired by the weapon simulator corresponding to the predetermined number of steps 1456 on toothed element 1412, the pneumatic gate 1416 aligns between pneumatic branch 1418 and pneumatic bridge 1420 thereby allowing air through pneumatic gate 1416 and into pneumatic bridge 1420. Air then enters pressure chamber 1442 below lifter 1440 as described above. Lifter 1440 extends from magazine 1422 to engage the bolt 1424 of the weapon simulator which, in turn, immobilizes the weapon bolt 1424.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A pneumatic counting apparatus for a weapon simulator producing a cyclic motion upon simulated firing and including a compressed gas storage reservoir, said apparatus comprising:

a toothed element adapted for articulation within the apparatus;

said toothed element including a plurality of steps, a first face and a second face;

an actuator adapted for engaging the steps of said toothed element so as to articulate said toothed element;

said actuator adapted to be driven by the simulated weapon's cyclic motion;

said toothed element having a pneumatic gate therethrough;

a pneumatic branch in pneumatic communication with the gas storage reservoir and terminating at said first face of said toothed element;

a pneumatic bridge extending from said second face of said toothed element and adapted for selective flow of compressed gas;

said pneumatic gate adapted for selective flow of compressed gas between said first and second face of the toothed element to provide pneumatic communication between said pneumatic branch and said pneumatic bridge.

2. The pneumatic counting apparatus of claim 1 wherein said toothed element includes a vent notch on said second face adapted to relieve pressure from under said lifter to allow said lifter to retract.

3. The pneumatic counting apparatus of claim 1 wherein said apparatus is configured as a simulated firearm magazine.

4. The pneumatic counting apparatus of claim 1 wherein said pneumatic branch between said compressed gas storage reservoir and said pneumatic gate includes a pressure regulator.

5. The pneumatic counting apparatus of claim 1 wherein said pneumatic branch in communication with said pneumatic gate includes a pressure reducer.

6. The pneumatic counting apparatus of claim 1 having an outlet for compressed gas to power the weapon simulator cyclic motion.

7. The pneumatic counting apparatus of claim 1 including means for stopping the simulated firing of the weapon simulator when said toothed element is advanced to line up said pneumatic gate to allow said compressed gas from the compressed gas storage reservoir to activate a lifter which extends a weapon catch to interrupt the simulated weapon cyclic motion.

8. The pneumatic counting apparatus of claim 1 wherein said toothed element is a wheel having a circumference with said steps on said circumference such that said actuator is adapted for engaging said steps.

9. The pneumatic counting apparatus of claim 1 wherein said toothed element is a linear bar including including at least one tooth along said length of said linear bar such that said actuator is adapted for engaging said steps.

10. The pneumatic counting apparatus of claim 9 wherein said toothed element has a thumb knob for manually sliding said bar into a desired position corresponding with a round count.

11. The pneumatic counting apparatus of claim 9 wherein said actuator includes a lever adapted for engaging said steps.

12. The pneumatic counting apparatus of claim 9 wherein said actuator includes a plurality of teeth adapted for engaging said plurality of steps.

13. The pneumatic counting apparatus of claim 12 wherein said linear bar includes a longitudinal axis and said actuator includes a longitudinal axis;

said actuator adapted for movement along its longitudinal axis in association with contact with a slide, bolt carrier or reciprocating part of the simulated weapon producing the cyclic motion;

said linear bar adapted for movement along its longitudinal axis;

a rocker adapted for engaging said actuator;

said rocker secured in a magazine and adapted for pivotal movement.

14. The pneumatic counting apparatus of claim 13 wherein said actuator includes a shoulder and said rocker includes a cavity adapted for receiving said shoulder such that said shoulder is adapted for movement within said cavity;

said cavity including a spring adapted for biasing said actuator along said longitudinal axis of said actuator.

15. The pneumatic counting apparatus of claim 14 wherein said actuator is adapted to pivot within said magazine; said at least one tooth of said actuator engages one of said plurality of steps on said linear bar such that movement of said actuator along said longitudinal axis of said actuator in a first direction to a first position against said spring in association with contact with said slide bolt carrier, or reciprocating part causes said linear bar to move along said longitudinal axis of said bar;

said spring biases said shoulder in a second direction to a second position in said cavity away from said rocker enabling said rocker to pivot;

said shoulder positioned in said cavity in said second position causing said actuator to pivot such that said at least one tooth of said actuator disengages from said one of said plurality of steps on said linear bar and said spring biases said rocker to said second position.

16. The pneumatic counting apparatus of claim 1 further comprising a counter for counting rounds between a full count and an empty count, and, a rocker adapted to disengage said actuator from said toothed element to allow for manually sliding said counter to return said counter to full count or to any desired round count between said full count and said empty count.

17. The pneumatic counting apparatus of claim 1 wherein the cyclic motion is provided by a slide or bolt on the weapon simulator further comprising a lifter in pneumatic communication with said compressed gas storage reservoir;

said lifter adapted for engagement with said slide bolt carrier, or reciprocating part on the weapon simulator.

18. The pneumatic counting apparatus of claim 17 further including a spring adapted for biasing said lifter.

* * * * *